US005882481A

United States Patent [19]

Kahl et al.

[11] Patent Number: 5,882,481

[45] Date of Patent: Mar. 16, 1999

[54] BLOCKING DEVICE IN A PAPER-MAKING MACHINE

[75] Inventors: Peter Kahl, Gerstetten; Wolfgang Müller, Giengen; Thomas Buchmaier, Steinweiler, all of Germany

[73] Assignee: Voith Sulzer Papiermaschinen GmbH, Heidenheim, Germany

[21] Appl. No.: 758,525

[22] Filed: Nov. 29, 1996

[30] Foreign Application Priority Data

Dec. 1, 1995 [DE] Germany ..... 195 44 881

[51] Int. Cl.[6] ..... D21F 5/00

[52] U.S. Cl. ..... 162/232; 34/117; 34/120; 162/290

[58] Field of Search ..... 162/290, 375, 162/193, 232; 34/117, 120

[56] References Cited

U.S. PATENT DOCUMENTS

| | | | |
|---|---|---|---|
| 3,875,682 | 4/1975 | Justus et al. | 34/120 |
| 4,359,828 | 11/1982 | Thomas | 34/117 |
| 4,856,205 | 8/1989 | Meyer et al. | 34/120 |
| 5,019,213 | 5/1991 | Virta et al. | 162/193 |
| 5,086,571 | 2/1992 | Hietanen | 34/120 |

FOREIGN PATENT DOCUMENTS

| | | |
|---|---|---|
| 692569 | 1/1996 | European Pat. Off. . |
| 9305752 | 12/1993 | Germany . |

OTHER PUBLICATIONS

Greimel et al., "Bahnstabilisatoren in Trockenpartien Schnellaufender Papiermaschinen", *Wochenblat Für Papierfabrikation*, vol. 4, pp. 99 –104 (1986).

*Primary Examiner*—Karen M. Hastings
*Attorney, Agent, or Firm*—Greenblum & Bernstein, P.L.C.

[57] ABSTRACT

A machine for the production of a continuous web, particularly of paper or cardboard, may include a plurality of rolls around which a continuous web may be guided. The machine may also include a blocking device, arranged in a vicinity of an edge of the continuous web, to prevent turbulences and arranged at a predetermined distance from a free stretch formed by the continuous web traveling between two adjacent rolls. The blocking device may extend along a longitudinal portion of the free stretch, i.e, in a transport direction of the continuous web, and/or may extend across a portion of the free stretch transverse to the transport direction of the continuous web.

33 Claims, 3 Drawing Sheets

BLOCKING DEVICE IN A PAPER-MAKING MACHINE

CROSS-REFERENCE OF RELATED APPLICATIONS

The present invention claims the priority under 35 U.S.C. § 119 of German Patent Application No. 195 44 881.2 filed on Dec. 1, 1995, the disclosure of which is expressly incorporated by reference herein in its entirety.

BACKGROUND OF THE INVENTION

1. Field of the Invention

The present invention may be directed to a machine for the producing a continuous fibrous web of, e.g., paper or cardboard web. The machine may include a blocking device positioned near a free stretch for preventing turbulences in a direction along the length and width of the continuous web.

2. Discussion of the Background Information

During the production of a continuous web, the web and a transport belt may be moved around various rolls in the production machine in a meandering manner. Various press and drier rolls are used for this purpose in order to guide the web along a certain belt path. The web run is determined by the positioning of the guide rolls. Thus, the web can be led around, e.g., a drier cylinder and guide rolls, so that a free stretch results, i.e., a web section in which the web does not touch any roll. Free stretches are used, e.g., to affect the shrinkage and the curl of the web.

It has been shown that the web edge is lifted or loosened from the transport belt by air currents in the area of the free stretches. Such lifting or loosening of the web from the transport belt results in crimping that leads to unacceptable quality deficiencies, and may result in a web break with corresponding production interruptions.

SUMMARY OF THE INVENTION

Thus, it is an objective of the present invention to create a machine for producing a continuous web which does not suffer from the above-noted disadvantages.

Thus, the present invention may be directed to a machine for the producing a continuous web of, e.g., paper or cardboard web. The machine may include a blocking device positioned near a free stretch for preventing turbulences in a direction along the length and width of the continuous web. Because the air currents present in the area of the free stretch may affect the continuous web, the present invention may eliminate crimping or lifting of the web edges. The influencing (or deflection) of the air currents may be effected through a blocking device arranged at a predetermined distance from a surface of a free stretch. The blocking device may prevent turbulences caused by the air currents and may affect the boundary layer or air layer that is pulled along by one of the continuous web or the transport belt. The blocking device may be designed to extend in at least one of a transport direction of the continuous web or transverse to the transport direction of the continuous web and to extend across an area of the free stretch, to prevent turbulences within the boundary layer. Thus, the web edges of the continuous web may be protected from crimping or lifting off the transport belt.

According to a preferred embodiment of the present invention, the blocking device may include at least one blocking element arranged in the area of the air boundary layer, i.e., an air layer pulled along by the web that extends at least across an edge area of the web. According to this arrangement, the air boundary layer at the edge of the web may be particularly affected such that the turbulences due to the air currents and the lifting or crimping of the continuous web can be prevented.

In the machine according to the present invention, the blocking element may include a passive air guidance device that does not include any suction or air discharge areas. This particular design may enable the machine of the present invention to operate the blocking device in simple and cost efficient manner.

The blocking device according to the present invention may be arranged parallel to a surface of the free stretch of the continuous web. This arrangement may effectively influence the boundary layer existing in the area of the free stretch.

The web producing machine according to the present invention may also include a scraper device to lift the air boundary layer from the roll surface from which the free stretch begins. The blocking elements of the blocking device may be arranged between the scraper device and the free stretch. The blocking elements may effectively block the air boundary layer and may prevent uncontrolled air currents from adversely affecting the continuous web.

Accordingly, the present invention may be directed to a machine for the production of a continuous web that may include a plurality of rolls around which the continuous web is guided. The plurality of rolls and the continuous web may form at least one free stretch. The machine may also include a blocking device, arranged in a vicinity of an edge of the continuous web, to prevent turbulences and positioned at a predetermined distance from the free stretch. The blocking device may extend in at least one of along a portion of the free stretch in a transport direction of the continuous web and transverse to the transport direction of the continuous web.

In accordance with another feature of the present invention, the blocking device may include at least one blocking device element positioned in a vicinity of a boundary air layer carried along by the continuous web and may extend across the continuous web, transverse to the transport direction, and over a lateral edge section of the continuous web.

In accordance with still another feature of the present invention, the blocking device may include a passive air guidance device.

In accordance with another feature of the present invention, the blocking device element may be movably mounted for movement relative a plane formed by the continuous web in a direction perpendicular to the plane and may be movably mounted for movement parallel to the plane formed by the continuous web in a direction parallel to the transport direction.

In accordance with yet another feature of the present invention, the blocking device element may be positioned parallel to a surface of the free stretch.

In accordance with a further feature of the present invention, the blocking device element may extend across a width of the continuous web.

In accordance with still another feature of the present invention, the blocking device may include a plurality of blocking device elements arranged at a distance from each other, the blocking device elements spaced in at least one of the transport direction of the continuous web and transverse to the transport direction of the continuous web.

In accordance with yet another feature of the present invention, the blocking device may be positioned in a vicinity of the free stretch and arranged with respect to a path of the continuous web after running off a first roll.

In accordance with still another feature of the present invention, the machine may further include a scraper device for removing the boundary air layer from a surface of a first one of the plurality of rolls and the first roll and the continuous web forming an end point of the free stretch. A portion of the scraper device may be arranged adjacent to a surface of the first roll and may be positioned downstream from the end point of the free stretch, with respect to a direction of rotation of the first roll.

In accordance with a further feature of the present invention, the scraper device may include a wall arranged substantially parallel to a surface of the free stretch and the blocking device may be arranged in an open space between the scraper device and the free stretch.

In accordance with still another feature of the present invention, the blocking device may be positioned in a vicinity of the free stretch and with respect to a point at which the continuous web is guided onto a first of the plurality of rolls.

In accordance with yet another feature of the present invention, the blocking device may include a blocking device element and an air guidance device having at least one air guidance element positioned substantially perpendicular to a free stretch surface.

In accordance with a further feature of the present invention, the air guidance element may be positioned on at least one end of the blocking device element to perpendicularly face the edges of the continuous web in the free stretch.

In accordance with a still further feature of the present invention, the air guidance element may include a cross-sectional area greater than a cross-sectional area of the blocking device element.

In accordance with another feature of the present invention, the air guidance element may extend substantially across the free stretch in a direction transverse to the transport direction.

In accordance with still a further feature of the present invention, the air guidance element may be arranged to cover at least an open space between the blocking device element and the free stretch.

In accordance with yet another feature of the present invention, the air guidance element may be arranged to cover a space between the scraper device and the free stretch.

In accordance with a still further feature of the present invention, the air guidance element may be arranged to cover at least one of the scraper device, at least a portion of at least one of the plurality of rolls forming the free stretch, and at least a portion of the edge of the continuous web in the free stretch.

In accordance with another feature of the present invention, the air guidance element may be movably mounted for positioning in accordance with air current conditions within the machine.

In accordance with another feature of the present invention, the machine may include an automatic adjustment device to automatically adjust the air guidance element.

In accordance with still another feature of the present invention, the plane formed by the continuous web may be formed between contact points of the continuous web and the plurality of rolls which form the free stretch.

According to another aspect of the present invention, the present invention may be directed to a machine for producing a continuous fibrous web. The machine may include a first roll, a second roll, a free stretch formed by a portion of the continuous web arranged between the first and second rolls, and a blocking device positioned adjacent the free stretch to reduce undesired influences on at least edges of the free stretch due to air currents within the machine. The blocking device may be positioned substantially parallel to the free stretch.

In accordance with another feature of the present invention, the blocking device may extend in a longitudinal direction substantially similar to a transport direction of the continuous web and extending in a direction transverse to the transport direction.

In accordance with still another feature of the present invention, the machine may further include a scraper device including a scraper blade and a boundary wall. The scraper blade and boundary wall may be positioned substantially parallel to the free stretch.

In accordance with yet another feature of the present invention, the machine may further include at least one air guidance element positioned substantially perpendicular to the blocking device.

In accordance with still another feature of the present invention, the blocking element and the at least one air guidance element may be mounted for relative movement.

In accordance with a further feature of the present invention, the blocking element and the at least one air guidance element may be mounted for unitary movement.

In accordance with yet another feature of the present invention, the at least one air guidance element may be positioned substantially perpendicular to the free stretch.

The blocking device of the present invention may include an air deflection device that may include at least one air deflection element arranged substantially vertical with respect to the free stretch. This particular embodiment of the present invention may prevent crimping or lifting of the edges of the web in a particularly effective manner.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
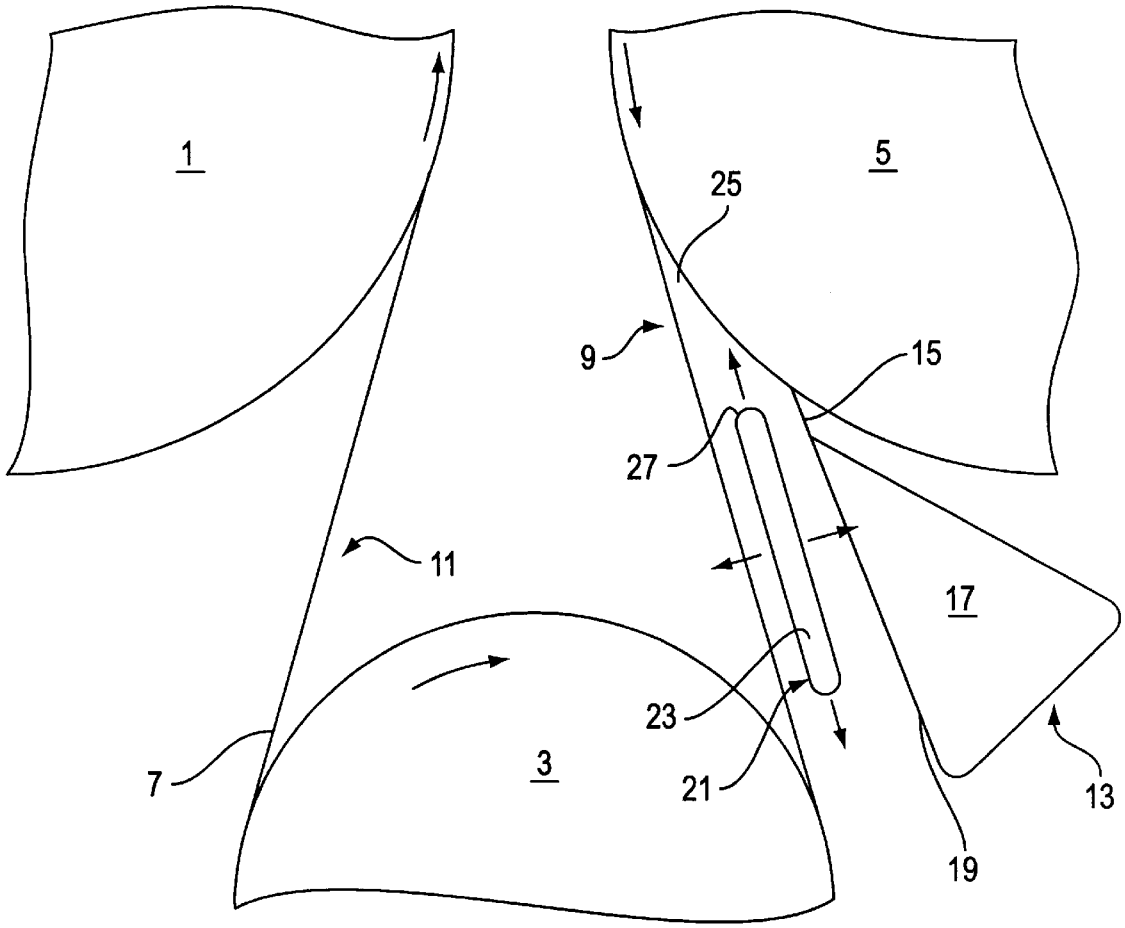
FIG. 1 illustrates a schematic side view of a first embodiment of a blocking device according to the present invention.

FIG. 1 shows at least a portion of each of a plurality of rolls 1, 3, and 5 and a continuous fibrous web 7 which may be guided around rolls 1, 3, 5 in a meandering (or winding) path. The continuous fibrous web may be, for example, paper or cardboard. The continuous web 7 may also be guided around rolls 1, 3, 5 by a transport belt, not shown, traversing the same path shown by web 7 in at least this particular portion of the machine. Each of rolls 1, 3, and 5 show a directional arrow which may indicate the direction of rotation for each roll and thus may also indicate a direction of movement or transport for continuous web 7. Thus, as shown in FIG. 1, continuous web 7 (and the transport web, if applicable) may run from roll 5, around roll 3, and then continue on to roll 1. Rolls 1 and 5 may be, e.g., drier cylinders and roll 3 may be, e.g., a guide roll.

A first free stretch 9 may be formed between roll 5 and roll 3 and a second free stretch 11 may be formed between roll 3 and roll 1. In each of free stretches 9 and 11, continuous web 7 is not directly supported by rolls. For example, in free stretch 9, continuous web 7 may be lifted off (or lose contact) with roll 5 at a predetermined point and may freely travel over an open space until contacting roll 3 at another predetermined point. It is noted that the continuous web may traverse the free stretches alone or the continuous web may traverse the free stretches while being guided by the transport belt (not shown). A scraper device 13 may positioned to operate in conjunction with an outer surface of roll 5. As continuous web 7 traverses rolls 1, 3, and 5, the moving continuous web may create air currents that are likewise pulled along by the moving continuous web. Further, each rotating roll may create an air boundary layer around its outer surface and pull the air boundary layer along as it rotates. Scraper device 13 may be positioned to lift the air boundary layer from the outer surface of roll 5, where free stretch 9 begins. Thus, the air boundary layer created by rotating roll 5 may be diverted away from, and not interfere with (or adversely affect), free stretch 9. Accordingly, a scraper blade 15 may be attached to a scraper element 17 and may abut or rest against the outer surface of roll 5. Scraper device 13 may also include a boundary wall 19 which is arranged to substantially parallel to first free stretch 9.

A blocking device 21 may be positioned adjacent continuous web 7 in free stretch 9. In particular, blocking device 21 may be positioned near an edge area of continuous web 7 to prevent turbulences resulting from air currents generated within the machine, e.g., by the movement of the continuous web, by the movement of the transport belt (if applicable), by the rotation of the rolls, etc. Blocking device 21 may also be positioned at a predetermined distance from a surface of the free stretch 9 portion of continuous web 7 and a predetermined distance from a point at which the continuous web 7 is lifted from roll 5. Blocking device 21 may include a blocking device element 23 which may extend in a longitudinal direction parallel to the transport direction of continuous web 7 to form a predetermined length and in may extend in a direction transverse to the transport direction of continuous web 7 to form a predetermined width, i.e., perpendicular to a plane formed by FIG. 1. Thus, the width of blocking device element 23 may extend along and across at least a portion of the surface area of free stretch 9. Blocking element 23 may be designed to substantially flat. Thus, for example, the length and width of blocking device element 23 may be substantially greater than a thickness of blocking device element 23.

The predetermined length of blocking device element 23 may be selected such that the length of blocking device element 23 is approximately one-half the free stretch length, or such that the length of blocking device element 23 may cover approximately one-half of free stretch 9. The edges of blocking device element 23 may be rounded to provide an aerodynamic design and to prevent formation of additional turbulences in the vicinity of free stretch 9.

Blocking device element 23 may be positioned in the vicinity of the boundary layer provided on an outer side of continuous web 7 which faces roll 5. It may be positioned such that the air lifted by scraper blade 15 from the outer surface of roller 5 may not reach an outer surface of free stretch 9. A lateral edge 27 of blocking device element 23 facing an opening nip 25, i.e., where continuous web 7 is lifted off of roller 5, is positioned close to a contact point of scraper blade 15 on the outer surface of roll 5.

A first longitudinal surface of blocking device element 23 may face the outer surface of free stretch 9, and a second longitudinal surface of blocking device element 23, opposite the first longitudinal surface, may be substantially parallel to the first longitudinal surface. The second longitudinal surface may be positioned to face scraper device 17 and to be substantially parallel to border wall 19 of scraper device 17.

Blocking device 21, or blocking device element 23, may be mounted in a flexible or movable manner so as to arrange blocking device 21 (or blocking device elements 23) parallel to free stretch 9 for movement perpendicular to the outer surface of free stretch 9 and to arrange the longitudinal position of blocking device 21 (or blocking device elements 23) along free stretch 9 between respective contact points of continuous web 7 on rolls 5 and 3 for movement in and against the transport direction of continuous web 7. In this manner, the air currents and turbulences generated by the operation of the web producing machine, e.g., movement of the continuous web or rotation of the rolls, may be controlled and their deleterious effects may be minimized. The arrangement of blocking device 21 can also be adapted in accordance with various operating conditions, particularly to varying transport speeds of continuous web 7.

Figure 3:
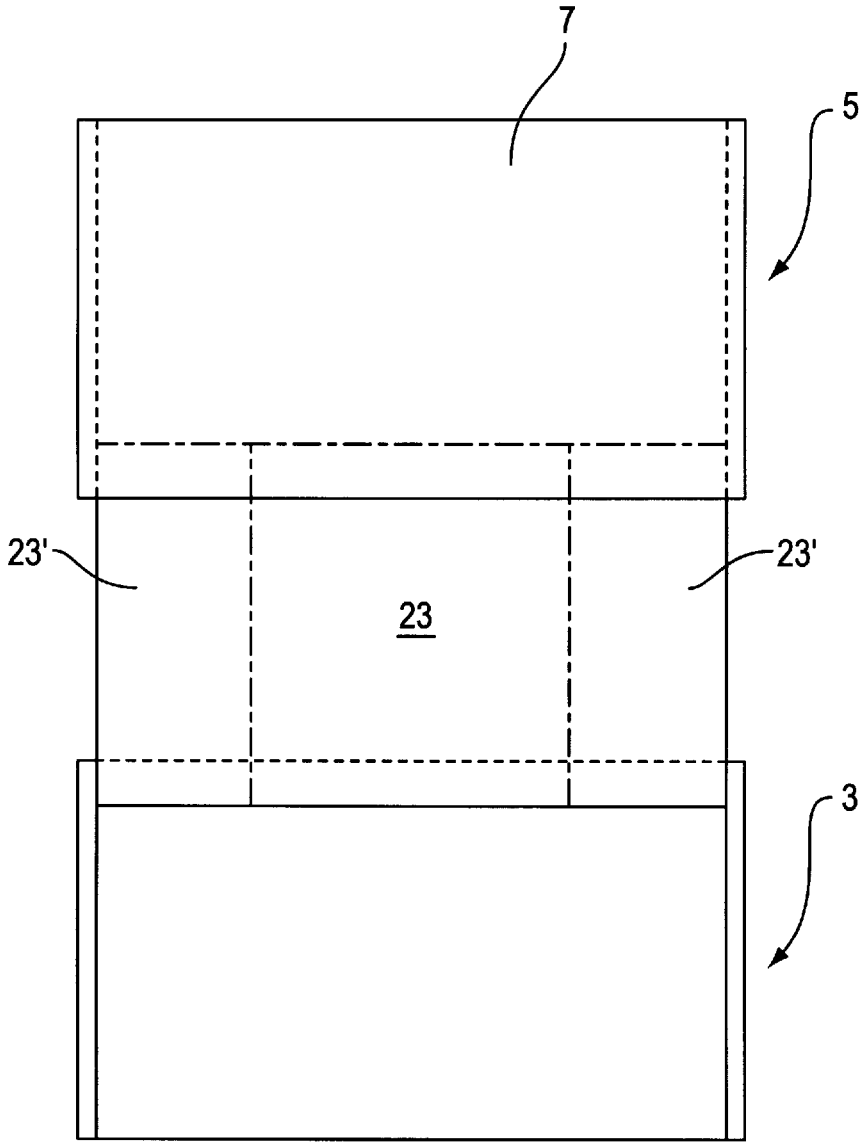
FIG. 3 illustrated examples of positioning of a blocking element including one or more partial elements.

Blocking device element 23 may be provided at least in the vicinity of the web edge and may extend more or less across the entire width of continuous web 7. Further, as illustrated, e.g., in FIG. 3, blocking device element 23 may consist of an uninterrupted single or unitary element or may consist of a plurality of partial elements 23' (delineated by the dash-dash-dot lines) arranged at a predetermined distance from each other across the width of continuous web 7. The present invention also contemplates that, in the transport direction, blocking device element 23 may include a plurality of adjacent partial elements connected in a suitable manner.

In an alternative to the arrangement shown in FIG. 1, blocking device 21 may be positioned with respect to second free stretch 11. Thus, blocking device 21 may positioned substantially parallel to continuous web 7 and along the longitudinal run of free stretch 11 between roll 3 and roll 1. In this alternative arrangement, blocking device 21 may be coordinated with the outer surface of continuous web 7 running to roll 1.

According to another alternative embodiment, the present invention contemplates positioning a blocking device 21 along each of free stretches 9 and 11.

Figure 2:
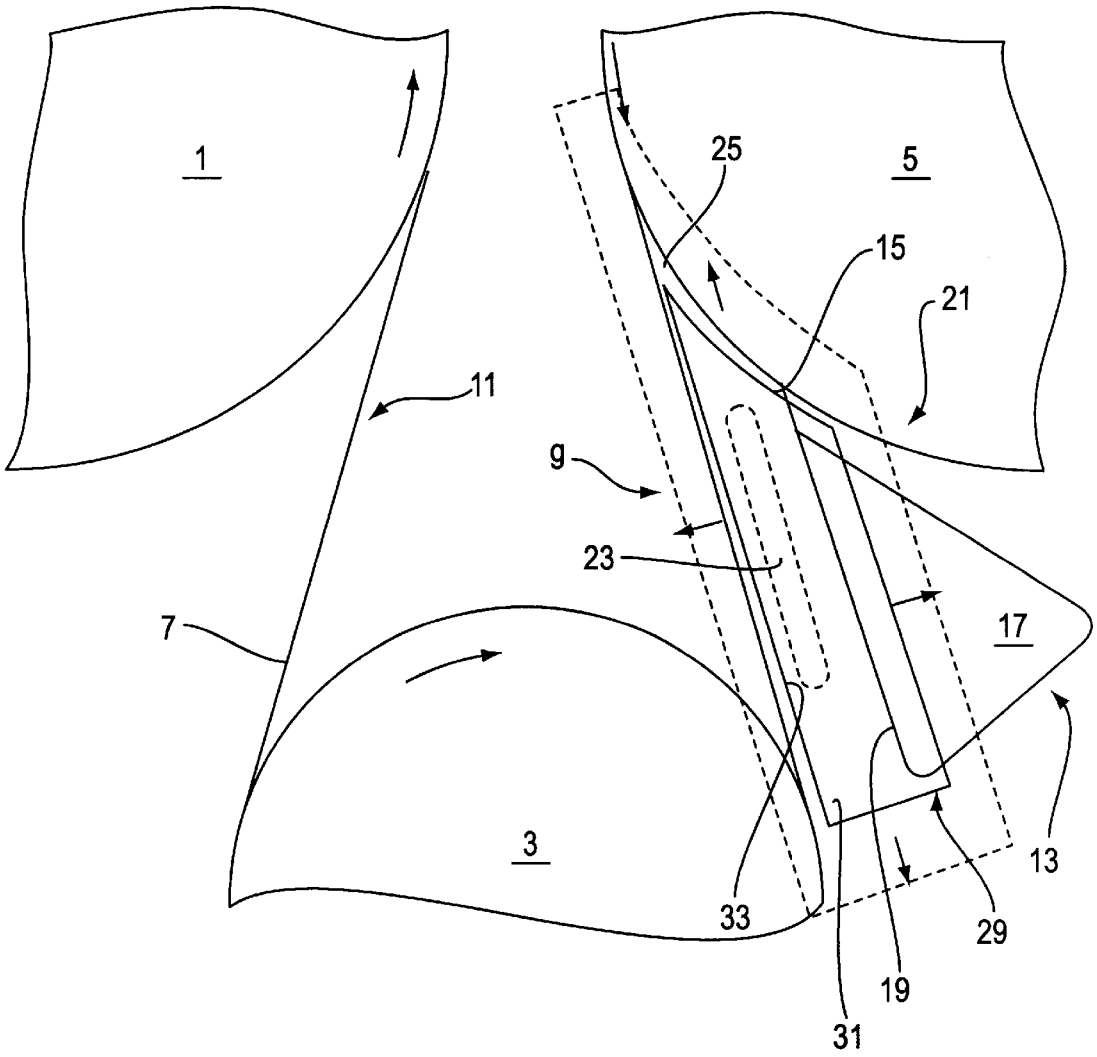
FIG. 2 illustrates a schematic side view of a second embodiment of a blocking device according to the present invention.

As shown in FIG. 2, the effect of blocking device 21 may be enhanced by utilizing an air guidance device 29 which may include at least one air guidance element 31 to prevent turbulences. Air guidance element 31 may be positioned substantially perpendicular to blocking device element 23 of blocking device 21 so that a front surface (or face) of blocking device element 23 is positioned to face a surface of the free stretch. FIG. 2 illustrates that air guidance element 31 is positioned substantially perpendicularly to the surface of the free stretch and at least extending forwardly from the front surface of blocking device element 23 toward the surface of the free stretch. Air guidance element 31 may also include a lengthwise edge 33 facing continuous web 7 and may be positioned parallel to the outer surface continuous web 7 at free stretch 9 at a small distance. A length of air guidance element 31 may be selected so that the length extends essentially along the full length of free stretch 9, i.e., air guidance element 31 may include an upper portion that reaches deep into opening nip 25. A height of air guidance element 31 may be selected to approximately cover the area between scraper device 13 and the outer surface of continuous web 7 of free stretch 9 and to cover areas of scraper blade device 17.

The length and width of air guidance element 31 may be adapted to accommodate various air current conditions.

Air guidance element 31 may alternatively be provided to span the edge of continuous web 7 and, if desired, may span parts of roll 5, the scraper device 13 and roll 3, as shown in the dotted lines. Air guidance device 29 may also be designed to be large enough to cover free stretch 9 along the entire edge area to influence and control the uncontrolled air currents and to prevent a crimping or lifting of the web edges. This alternative may prevent undesired air currents from flowing under the web edges from the side.

Preferably, air guidance device 29 may be movably mounted so that its position may be adapted in accordance with varying air current conditions. For example, air guidance element 31 may be jointly moved with blocking device element 23. Alternatively, air guidance element 31 may be mounted for relative movement with respect to blocking device element 23. Thus, air guidance element 31 may be adjusted independently of the position of blocking device element 23.

According to another alternative embodiment of the present invention, air guidance element 31 may be provided with openings to control the air currents. Further, blocking device element 23 may be designed to be very small and may be provided for holding air guidance device 29. This embodiment is preferable when it is desired to control air currents at the very edge of web 7, but no other air currents are to be controlled or influenced.

Positioning of blocking device element 23 and air guidance element 31 may be done manually. However, an automatic positioning of each element in accordance with the existing air current conditions may be contemplated by the ordinarily skilled artisan through the use of conventional control system devices. In this regard, the present invention ensures flexibility in influencing air currents and in preventing crimping or lifting of the edges of continuous web 7.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

From the foregoing, the embodiment of the machine for the production of a continuous web shown in FIGS. 1 and 2 is not limited to the production of paper or cardboard webs. The present invention may be applied to all cases in which a continuous web is guided in a meandering (winding) manner across several rolls during production. The present invention is particularly useful at high speed, where air currents may adversely lead to crimping or lifting off of the web edges and may impede the production process. In a further alternative, existing machines can be retrofitted with the blocking device of the present invention.

What is claimed:

1. A machine for the production of a continuous web comprising:

a plurality of rolls around which the continuous web is guided;

said plurality of rolls and said continuous web forming at least one free stretch;

a blocking device arranged in a vicinity of an edge of the continuous web, to prevent turbulences and lifting of the continuous web edges and positioned at a predetermined distance from the free stretch;

the blocking device extending in at least one of along a portion of the free stretch in a transport direction of the continuous web and transverse to the transport direction of the continuous web; and the blocking device comprising a blocking device element having a front surface positioned to face a surface of the free stretch and an air guidance device that includes at least one air guidance element positioned substantially perpendicularly to the surface of the free stretch and at least extending forwardly from the front surface toward the surface of the free stretch.

2. The machine according to calim 1, the blocking device comprising at least one blocking device element positioned in a vicinity of a boundary air layer carried along by the continuous web and extending across the countinuous web, transverse to the transport direction, and over a lateral edge section of the contiouous web.

3. The machine according to claim 1, the blocking device being a passive device.

4. The machine according to claim 1, the blocking device element being movably mounted for movement relative a plane formed by the continuous web in a direction perpendicular to the plane and parallel to the plane formed by the continuous web in a direction parallel to the transport direction.

5. The machine according to claim 1, the blocking device element being positioned parallel to a surface of the free stretch.

6. The machine according to claim 4, the plane formed by the continuous web being formed between contact points of the continuous web and the plurality of rolls which form the free stretch.

7. The machine according to claim 1, the blocking device comprising a plurality of blocking device elements arranged at a distance from each other, the blocking device elements spaced in at least one of the transport direction of the continuous web and transverse to the transport direction of the continuous web.

8. The machine according to claim 1, the blocking device being positioned in a vicinity of the free stretch and arranged with respect to a path of the continuous web after running off a first roll.

9. The machine according to claim 1, further comprising a scraper device removing the boundary air layer from a surface of a first one of the plurality of rolls and the first roll and the continuous web forming an end point of the free stretch;

a portion of the scraper device being arranged adjacent a surface of the first roll and positioned downstream from the end point of the free stretch, with respect to a direction of rotation of the first roll.

10. The machine according to claim 9, the scraper device comprising a wall arranged substantially parallel to a surface of the free stretch; and the blocking device being arranged in an open space between the scraper device and the free stretch.

11. The machine according to claim 1, the blocking device being positioned in a vicinity of the free stretch and with respect to a point at which the continuous web is guided onto a first of the plurality of rolls.

12. The machine according to claim 1, the blocking device being only positioned in the vicinity of the edge of the continuous web.

13. The machine according to claim 1, the air guidance element positioned on at least one end of the blocking device element to perpendicularly face the edges of the continuous web in the free stretch.

14. The machine according to claim 1, the air guidance element comprising a cross-sectional area greater than a cross-sectional area of the blocking device element.

15. The machine according to claim 1, the air guidance element extending substantially across the free stretch in a direction transverse to the transport direction.

16. The machine according to claim 1, the air guidance element arranged to cover at least an open space between the blocking device element and the free stretch.

17. The machine according to claim 1, further comprising a scraper device positioned adjacent the free stretch; and the air guidance element arranged to cover a space between the scraper device and the free stretch.

18. The machine according to claim 1, further comprising a scraper device positioned adjacent the free stretch; and the air guidance element arranged to cover at least one of the scraper device, at least a portion of at least one of the plurality of rolls forming the free stretch, and at least a portion of the edge of the continuous web in the free stretch.

19. The machine according to claim 1, the air guidance element being movably mounted for positioning in accordance with air current conditions within the machine.

20. The machine according to claim 19, further comprising an automatic adjustment device to automatically adjust the air guidance element.

21. The machine according to claim 1, the blocking device element extending across an entire width of the continuous fibrous web.

22. The machine according to claim 1, the blocking device element having a width less than a width of the continuous fibrous web.

23. The machine according to claim 22, the blocking device comprising first and second blocking devices;

the first blocking device only positioned in a vicinity of a first edge of the continuous web, and the second blocking device only positioned in a vicinity of a second edge of the continuous web, wherein the first and second edges are opposite edges of the continuous web.

24. The machine according to claim 23, the first and second blocking devices are positioned over the first and second edges, respectively.

25. A machine for producing a continuous fibrous web comprising:

a first roll;

a second roll;

a free stretch portion formed by a portion of the continuous web arranged between the first and second rolls;

a blocking device positioned adjacent a vicinity of at least one edge of the continuous web in said free stretch to reduce undesired influences on, and lifting of the at least one edge of said free stretch due to air currents within the machine, the blocking device having a front face positioned to face the free stretch;

at least one air guidance element positioned substantially perpendicularly to said blocking device and at least extending forwardly from the front face toward the free stretch; and said blocking device positioned substantially parallel to said free stretch.

26. The machine according to claim 25, said blocking device extending in a longitudinal direction substantially similar to a transport direction of the continuous web and extending in a direction transverse to said transport direction.

27. The machine according claim 25, further comprising a scraper device including a scraper blade and a boundary wall, said scraper blade and boundary wall positioned substantially parallel to said free stretch.

28. The machine according to claim 25, said blocking device and said at least one air guidance element being mounted for relative movement.

29. The machine according to claim 25, said blocking element and said at least one air guidance element mounted for unitary movement.

30. The machine according to claim 25, said at least one air guidance element positioned substantially perpendicular to said free stretch.

31. The machine according to claim 25, the blocking device comprising first and second blocking devices;

the first blocking device only positioned in a vicinity of a first edge of the continuous web and the second blocking device only positioned in a vicinity of a second edge of the continuous web.

32. The machine according to claim 31, the first and second blocking devices are positioned over the first and second edges, respectively.

33. The machine according to claim 25, the blocking device being only positioned in the vicinity of the at least one edge of the continuous web.

* * * * *